US005179931A

United States Patent [19]

Leibowitz et al.

[11] Patent Number: 5,179,931

[45] Date of Patent: Jan. 19, 1993

[54] WORKING GEMSTONES

[75] Inventors: Alec Leibowitz, Edgeware; Peter Cooke, Maidenhead, both of England

[73] Assignee: Brilcut Patentanstalt, Liechtenstein

[21] Appl. No.: 695,345

[22] Filed: May 3, 1991

[30] Foreign Application Priority Data

May 4, 1990 [GB] United Kingdom ..... 9010176
Jul. 10, 1990 [GB] United Kingdom ..... 9015156

[51] Int. Cl.[5] ..... B28D 5/00

[52] U.S. Cl. ..... 125/30.01; 125/39; 51/206 R; 51/283 R

[58] Field of Search ..... 125/11.01, 11.03, 11.18, 125/30.01, 36, 39; 51/206 R, 206 P, 283 R

[56] References Cited

U.S. PATENT DOCUMENTS

| | | | |
|---|---|---|---|
| 943,191 | 12/1909 | Hull . | |
| 2,332,574 | 10/1943 | Hopp et al. | 51/50 |
| 3,568,368 | 3/1971 | Gwircman | 51/95 |

FOREIGN PATENT DOCUMENTS

| | | |
|---|---|---|
| 0347253 | 6/1989 | European Pat. Off. . |
| 90717 | 9/1990 | Israel . |
| 767290 | 12/1976 | South Africa . |
| 371401 | 4/1932 | United Kingdom . |
| 2225193 | 12/1940 | United Kingdom . |
| 2018173 | 1/1979 | United Kingdom . |
| 2074480 | 4/1980 | United Kingdom . |
| 2074910 | 4/1980 | United Kingdom . |
| 2082100 | 8/1980 | United Kingdom . |
| 2080712 | 6/1981 | United Kingdom . |
| 2117289 | 10/1983 | United Kingdom . |
| 2200582 | 1/1988 | United Kingdom . |

OTHER PUBLICATIONS

"Mitsubishi Metal Corp's Diamond Unit Expansion Plan," INDIAQUA Industrial Diamond Quarterly, No. 55, 1990/I, p. 87.

"Grinding, Polishing and Lapping," Machinery's Handbook; 18th Edition, pp. 1825-1841.

"Material-Removal Processes and Equipment"; Marks Standard Handbook for Mechanical Engineers; 8th Edition, Baumeister, Arrallone, Baumeister; pp. 13-66 to 13-69 and 6-139 and 6-140.

"Maxicut the Ultimate Bruting System"-Brochure.

*Primary Examiner*—James G. Smith

*Attorney, Agent, or Firm*—Kerkam, Stowell, Kondracki & Clarke

[57] ABSTRACT

In order to brute a gemstone, the gemstone 6 is rotated about an axis and is ground with a small bruting crown 1 rotating about a parallel axis. In the peripheral working face of the bruting crown 1 are set grinding diamonds or stones 4 each of which subtends an angle $\alpha$ of at least about 10° at the axis of the bruting crown 1. During working, reciprocatory axial motion is used between the bruting crown 1 and the gemstone 6. In order to set the end position of the bruting crown feed, the image 6' of the gemstone 6 and the image 1' of the bruting crown 1 are projected onto a screen 16. The screen 16 has indicia AB, BC, GH, IC representing the polished stone so that this polished stone can be fitted within the stone image 6'. The magnification of the optical system is changed and the stone is centered so that indicia in the form of bruted girdle diameter lines AB, GH represent the eventual bruted gridle diameter. The bruting crown 1 is then fed until the image of its profile is just inside the upper bruted girdle diameter line AD, and this position is set as the end position of the bruting crown feed.

26 Claims, 3 Drawing Sheets

WORKING GEMSTONES

BACKGROUND OF THE INVENTION

A first aspect of the present invention relates to a method of working a gemstone workpiece, comprising using a rotary working tool in the form of a multiple stone grinding head or bruting crown. For clarity, the gemstone being worked is referred to as the workpiece gemstone or stone, and the stones in the bruting crown are referred to as grinding stones.

The first aspect of the invention is particularly applicable to bruting, i.e. forming a girdle around a gemstone prior to polishing the stone; the girdle can be circular, or non-circular in the case of stones like marquises. However, it is also applicable to coning, i.e. forming the pavillion of the gemstone into a cone, although the tool is still called a bruting crown.

In general terms the invention is applicable to any suitable gemstone, but the invention has been deviated with reference to workpiece diamonds which are worked using diamond. The fundamental problem with diamonds is that no material is harder, and that to work a diamond, in general terms, the relative movement must be on the grain (defined by the crystollographic planes); if the relative movement is more than 7° off the grain, there is no working, and in general one must keep within 5° of the grain.

The precise mechanism which occurs is not known, but the following explains what is observed in practice. During cutting operations, such as bruting or in a coarse polishing process, termed grinding herein, micro-cleaving occurs on cleavage planes and small crystalline grains are abraded away. To achieve this, it is considered normally necessary to have some points on the working tool. However, the operation is relatively fast. During fine polishing, a form of molecular plastic deformation occurs and the only material removed from the workpiece diamond is non-diamond carbon. The operation is slow. A frosted bruted surface indicates grinding and a lustrous surface indicates fine polishing. Both grinding and fine polishing can occur at the same time; for instance a bruted stone often has a squarish girdle, having flattish sides which have been ground down and radiussed corners which have been fine polished.

Damage to the stones can occur if fine polishing commences during bruting; this may happen if the stones have lost their sharp cutting points, and no powder is being formed. If the workpiece is fed at the same rate as for bruting and fine polishing starts to occur, the stone may become chipped or knocked off the dop because fine polishing is much slower than grinding.

For bruting, some modern machines mutually bruts two stones which are rotating in the same direction (so that their peripheries engage in opposite directions) about parallel axes (see for instance GB-A-2 018 173, GB-A-2 082 100 and GB-A-2 200 582). Generally a gemstone is used as a tool to brute a partly processed gemstone to completion, whereupon the tool stone becomes the partly processed gemstone for completion by a new gemstone as the tool. Although this type of bruting is commercially successful, various disadvantages have been identified. One is the formation of squarish bruted girdles, referred to above. Another is that it is difficult to automate the finish as the feed depends on the reduction in diameter not only of the stone being bruted, but also of the other stone. Because of the irregularity of stones (particularly the tool stone), automatic control by controlled feed is not possible. The rate at which the stones are worn down is not predictable, as it is the sum of a known rate of removal (for the partly processed gemstone) and an unknown rate of removal (for the tool stone).

Grinding wheels are used generally in industry with a working face implemented with grit or powder, which may be diamonds; most frequently, the grits or powders are of 4 microns or less, down to below 1 micron. General practice is to use the grinding wheels with very high peripheral speeds. It has been suggested that such grinding wheels can be used for grinding or fine polishing gemstone facets or girdles, though the speeds are still relatively high. One problem is that the wheel wear is heavy so that it is difficult to automate the completion of the operation. There is also a danger that points on the workpiece stone can rip the grinding wheel. It is known to use whole grinding stones in drill bits and in dressing tools.

It is found desirable to provide a bruting tool which has a low and predictable rate of wear, which produces a rate of cutting which is acceptable in a commercial machine, and which allows automatic control of the bruting operation to the necessary degree of accuracy.

The second aspect of the invention relates in general to determining the bruted girdle diameter of a gemstone. GB-A-2 080 712, GA-A-2 200 582 and ZA-A-76/7290 disclose devices and methods for determining the bruted girdle diameter. It is desirable to simplify the methods used.

FIRST ASPECT OF THE INVENTION

According to a first aspect of the invention, a bruting crown is used which comprises a holder or shank - sized to suit a bruting machine - to which is cemented a number of diamonds, e.g. rough industrial diamonds or synthetic diamonds, either whole stones or pieces thereof, to form a ring of stones substantially evenly spaced around one end of the shank. In another form, the stones can be attached to a holder or boss which can then be centrally mounted upon a shank end.

When the bruting crown is manufactured, the grinding stones may present a small surface area, which will increase as the grinding stones are worn down. Before bruting, the bruting crown can be trued by running it on a piece of industrial diamond or using it to grind off large unwanted volumes of a gemstone, as a manual operation. As the grinding stones each subtend a relatively large angle (at least about 10°) when a large surface area of a grinding stone is exposed, the angle of incidence of the grinding stone on the workpiece stone changes significantly from the leading edge to the trailing edge of the grinding stone. This improves the possibility of some part of the surface of the grinding stone providing a grain angle which will abrade the workpiece stone. The greater the variations of angular contact relative to the crystallographic axes, the better the abrasion. Thus the grinding stones provide a much greater angular effect compared to grits. Furthermore, compared to grits, the grinding stones of the invention can be set on the surface of the bruting crown and much more grinding stone is exposed or will be exposed as the bruting crown wears. Also, although this also occurs with grits to a less marked effect, the sudden change in grain from one grinding stone in the invention to the next provides teeth for engagement with the workpiece stone. In addition, the diamond powder which is formed during the grinding works between the opposed surfaces and is important for the abrasive action.

As the exposed surfaces of the grinding stones are at a minimum at the beginning and end of the life of the bruting crown and at a maximum about half way through its life, smaller workpiece stones can be worked at the beginning and end of the bruting crown life, and larger workpiece stones when the exposed surfaces are greater.

It is found that the bruting crown of the invention wears very slowly; for instance, the reduction in radius can be 0.02 mm when bruting a 10 pt diamond (1 pt is 0.002 gm). This has the advantage that the finishing position can be preset and automated, once the desired finished girdle diameter has been determined (this can be determined for instance as in GA-A-2 200 582).

The invention has been found most practical for workpiece diamonds of a diameter of 2.5 mm and below, so that the machine of the invention is most satisfactory as a "smalls" machine, and the machine can be used to brute diamonds of for instance down to about 1 pt. Nevertheless, stones of 5 mm diameter and above have been successfully bruted using the invention.

The angle subtended by the grinding stones is preferably at least about 15° or 20° and preferably at the most about 60° or 55°.

In general, it is preferred that, as seen in axial section, the working face of the bruting crown be at an angle to the grinding wheel axis of substantially less than 90°; using a cup wheel, where the angle is 90°, it is found that grinding stones whose face is parallel to a cleavage plane do not wear and thus become proud of the other grinding stones and can break the workpiece gemstone. On testing, it was found that grinding increased significantly at angles between 70° and 60°, and in general it is preferred that the angle should be less than 75°, the most suitable arrangement being when the working face, as seen in axial section, is substantially parallel to the bruting crown axis. This latter arrangement provides the maximum angular change from the leading edge to the trailing edge of each grinding stone. It is found that when the grinding stones are set on a curved working face, although they may themselves initially have flat faces, they become curved to follow the curvature of the working face.

It is preferred to have relative reciprocation between the bruting crown and the workpiece stone, parallel to the face of the workpiece stone being worked, as seen in axial section—this will be parallel to the axis of the bruting crown when the bruting crown and workpiece stone are being rotated on parallel axes. The reciprocation gives a two-directional effect, and in bruting, the bruting crown has a pineapple-skin-like texture on the surface; this assists the surface to retain powder produced during the bruting and this in turn assists bruting. As it is difficult to arrange a saw-tooth reciprocation and relatively simple to arrange a sinusoidal reciprocation, the relative movement over the surface of the bruted workpiece stone will not be strictly straight, but one can talk of the average helix angle on the workpiece stone, which can be calculated from the relative axial and transverse speeds. The average helix angle is preferably greater than about 30° or about 45°, and is preferably less than about 80° or 75°, a suitable range being from about 60° to about 70°. The rate of reciprocation is preferably greater than about 100 cpm (cycles per minute) preferably about 200 cpm, it being found that if the reciprocation rate is significantly below 100 cpm, bearding occurs on the workpiece stone due to micro-cracks.

The relative speed between the peripheries of the bruting crown and the workpiece stone in the transverse plane, i.e. the plane normal to the axis of the bruting crown, is preferably less than about 20000 mm/min; if the speed is too high, the grinding stones may not cut and the workpiece stone can be dislodged from the workpiece holder. If the speed is too low, the bruted surface may be excessively rough. For stones with circular girdles, the relative speed is preferably less than about 12,000 mm/min or about 6,000 mm/min, though higher speeds are possible for workpiece stones such as marquises.

It is preferred to have relatively low bruting crown speeds, a preferred maximum being 150 rpm and a preferred minimum being 30 rpm, a value of about 60 or 100 rpm being suitable, though rates up to about 300 rpm, say 260 rpm, can be used. The workpiece stone speed, particularly with parallel-axis bruting, is preferably less than 300 rpm and is preferably more than 80 rpm, about 150 rpm being a suitable speed.

The diameter of the bruting crown will, to a certain extent, be determined by the maximum economical size of the grinding stones as, in order to obtain sufficient curvature of each grinding stone, one can use either large grinding stones or a small diameter bruting crown.

As it is generally desired to have the rotation speeds mentioned above, a bruting crown of too large a diameter will have an excessive linear velocity at its periphery. There is also a further problem with large diameters in that a rapid change of grain is better than a slow change of grain. Thus even if one can provide a say 50 or 30 mm diameter bruting crown with 6 mm diameter grinding stones, there may be difficulties. More preferably, the bruting crown has a diameter of about 50 mm or less, preferred diameters being about 9 mm or about 16 mm with which it is possible to use 3 mm diameter grinding stones, which are not too expensive—with for instance a 16 mm diameter bruting crown, one can have a core or shank diameter of 9 mm.

Diamonds of about 3 mm diameter are the preferred grinding stones—the total weight of all the diamonds in the bruting crown may be for instance about 3.5 ct (1 ct is 0.2 gm)—a 3 mm diameter diamond weighs about 0.25 ct. In general, the bruting crown preferably has 5, 7 or more stones and preferably has 20 or less stones, a preferred range being 6 or 10 to 12 or 15 stones; preferably 9 or 10 are used. The spaces between the grinding stones (if there is a single ring) preferably total about 10% of the periphery.

SECOND ASPECT OF THE INVENTION

A second aspect of the invention provides a method of bruting a gemstone using a bruting tool, in which method the location of the working periphery of the bruting tool is determined, the diameter of the bruted girdle of the gemstone is determined, and hence the radial feed required for bruting the gemstone is registered. During bruting, the tool is fed relative to the stone in a direction radial to the gemstone axis to thereby provide radial feed and brute the stone, and the tool is fed to the registered radial feed end position and the feed is ceased at the end position, the stone girdle being bruted to the girdle diameter determined.

The second aspect of the invention provides a simple way of setting the bruted diameter in the bruting machine by using the image of the bruting tool to determine the end position (in a radial sense) of the bruting tool. Normally, the bruting tool will be a rotating tool, and it is only necessary to determined the location of the edge of the tool. The edge of the tool will not be brought precisely to the girdle radius as determined because one has to allow for wear of the tool during the bruting operation and one may allow for elastic distortion of the machine, principally due to spring of the dop and dop holder. Normally the elastic distortion of the machine can be predicted with sufficient accuracy, and it is possible to provide a bruting tool whose wear is also predictable with sufficient accuracy. The bruting tool can be a grinding wheel, and one such tool is the bruting crown of the first aspect of the invention. Once the tool end position has been registered or set, an indication such as a bleep can be given when the tool reaches that position during bruting, or the tool feed can be automatically stopped and/or the tool automatically retracted.

Preferably, an image of the stone is projected onto a screen having indicia indicating the position of the bruted girdle, and an image of the tool or of another movable member is also projected onto the screen and the tool or other movable member is moved into a position related to the bruted girdle position.

The image of the stone can be optically projected onto the screen, and the screen can have indicia indicating the position of the bruted girdle, the magnification being changed to fit the image to the indicia. Thus the size of the gemstone can be fitted to the indicia using simple optical projection of the image of the stone profile and changing the magnification.

Any suitable optical arrangement can be used for changing the magnification. The preferred arrangement is to use a system having a long depth of focus and to move the screen itself along the optical axis (and preferably in a direction strictly parallel to the optical axis); in this way, the magnification can be almost doubled, which is ample for normal working practice; in normal working practice, the range of sizes of the diamonds is limited.

The indicia referred to above can be any suitable indicia for indicating the position of the bruted girdle. Various indicia are discussed in GB-A-2 200 582 and ZA-A-76/7290. However, they preferably comprise a) a line at an angle to the axis indicating the outline of the pavillion of the polished stone and b) at least a mark on this pavillion line and preferably a line parallel to the axis, which indicates the position of the bruted girdle. Further indicia that can be included are an axis line and also indicia which are a mirror image of the first indicia, on the other side of the axis line. It is possible to have a mark slightly closer to the axis than the bruted girdle position indicium, to indicate the final position of the image of the bruting tool (see the second aspect of the invention), though in practice this may not be necessary. Usually the axial position of the stone image in relation to the indicia is important so that the table of the stone would have to be located in a predetermined transverse plane in relation to the screen. Normal practice when bruting is for the stone to have its table already rough formed, and the table is stuck to the dop; automatic location of the table can be achieved by using a standard size dop which is inserted a standard distance into a dop holder.

Depending on where the screen is most conveniently place, the screen can be an opaque screen with front projection, or can be a translucent screen with back projection.

PREFERRED EMBODIMENTS

The invention will be further described, by way of example, with reference to the accompanying drawings, in which.

FIGS. 1 TO 4

Figure 1:
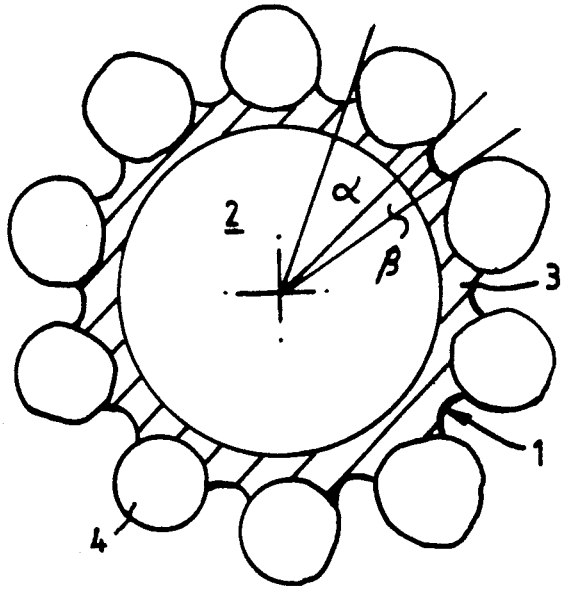
FIG. 1 is an end view of a bruting crown in accordance with the invention.

As shown in FIG. 1, the bruting crown 1 has a core or shank 2 which carries cement 3 in which are set diamond grinding stones 4 (which are full stones or pieces thereof). The grinding stones 4, of reasonable size, are spaced apart and set with a minimum of cement 3 to expose the cutting edges on the face of the bruting crown 1; the grinding stones 4 are not almost totally enclosed in the cement 3, at least at the beginning of grinding, and protrude from the cement 3 by over half their volume. The grinding stones 4 may, when being set, be orientated according to their crystal structure to better suit their crystalline breakdown, or pieces can be orientated to have flat faces normal to respective radii passing through their centres.

The cement 3 can interfere with the abrasion and cause polishing. By using as little cement as possible and using a cement with a filter (and also by using a stroke of for instance 4.5 mm), it was found that the cement 3 crumbles away without polishing. The cement 3 used for experiments was a heat cured epoxy resin filled with glass powder; in general, the materials should be soluble, for instance in hydrofluoric acid, so that the dust produced can be dissolved to recover diamond dust, which is valuable.

FIG. 1 indicates an angle $\alpha$ subtended at the centre or axis of the bruting crown between the leading part and the trailing part of one of the grinding stones 4, and the angle $\beta$ subtended by a gap between grinding stones 4.

Figure 2:
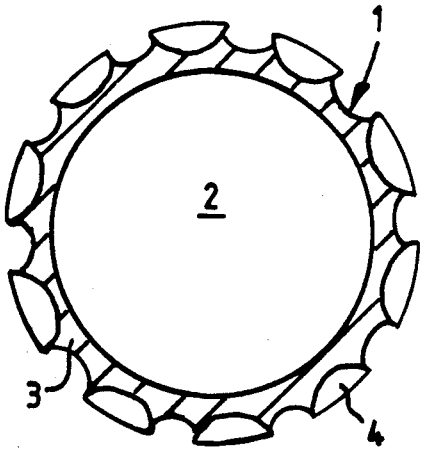
FIG. 2 is an end view of a bruting crown in accordance with the invention, after partial wear.

FIG. 2 shows the bruting crown 1 after a substantial period of use, in which the grinding stones 4 have been ground down.

Table 1 below gives various Examples in accordance with the invention.

TABLE 1

| Example | $d_1$ | $d_2$ | $d_3$ | N | R | $\alpha$ | |
|---|---|---|---|---|---|---|---|
| 1 | 15 | 3 | 9 | 9 | 1:5 | 28° | 12° |
| 2 | 15 | 3 | 9 | 10 | 1:5 | 28° | 8° |
| 3 | 13 | 2 | 9 | 15 | 1:6.5 | 20° | 4° |
| 4 | 12 | 3 | 6 | 6 | 1:4 | 37° | 23° |
| 5 | 10 | 2 | 6 | 10 | 1:5 | 28° | 8° |

$d_1$ is the bruting crown diameter, in mm;
$d_2$ is the average length of a grinding stone in the peripheral direction, in mm;
$d_3$ is the shank diameter (for Examples 4 and 5, the end of a 9 mm diameter shank was stepped down in 6 mm);
N is the number of grinding stones in the bruting crown;
R is the average ratio of the diameter of the grinding stones to the bruting crown diameter;
$\alpha$ is the average angle subtended by a grinding stone;
is the average angle subtended by the space between grinding stones.

The bruting crowns of Table 1 have a single ring of diamonds and its width is just slightly greater than diameter of the grinding stones. However, it is possible to have two or three rings with staggered grinding stones, particularly for bruting crowns of large diameter.

Figure 3:
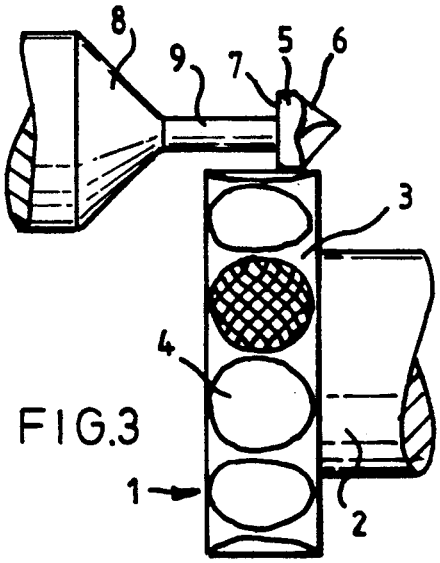
FIG. 3 is an end view of a bruting crown in use, with the bruting crown contacting a workpiece stone.
Figure 4:
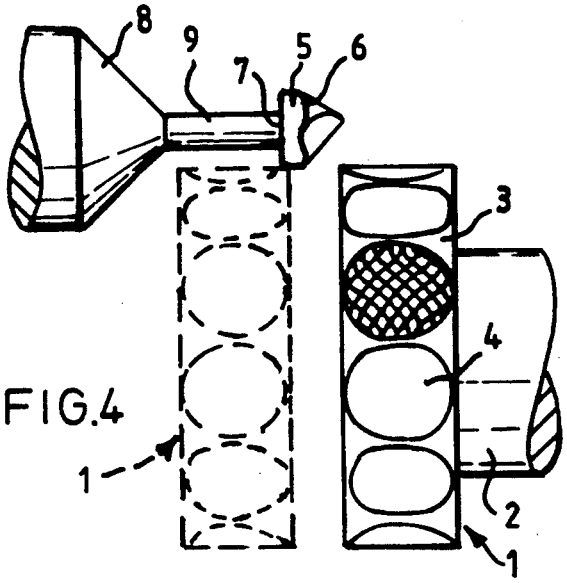
FIG. 4 is an end view of the bruting crown in use showing the position of the bruting crown at one end of its stroke (in full lines) and at the other end of its stroke (in broken lines)

FIGS. 3 and 4 show a bruting crown 1 in use, bruting a girdle 5 onto a gemstone 6 mounted on a dop 8. FIG. 4 shows the pineapple-skin-like texture on the surface of one of the grinding stones 4. The bruting crown 1 of FIGS. 3 and 4 has the grinding stones 4 set rather closer together than in the bruting crown 1 of FIGS. 1 and 2.

As shown in FIG. 4, the bruting machine is set up so that the length of a stroke is slightly greater than the width of the bruting crown 1 plus the expected depth of the bruted girdle 5, say 2.5 mm or 3 mm for a 2 mm diameter workpiece diamond 6; for larger workpiece diamonds 6, the stroke may be up to about 4.5 mm, for instance. There should be just a small overlap on the table side of the workpiece diamond 6 (see dashed lines) as the workpiece diamond 6 must be bruted right to the table 7. The bruting crown 1 can pass say 0.2 mm beyond the final position of the girdle 5 on the culet side (see full lines); as the bruting crown 1 comes back to a sloping part on the culet side, overlap is significant on the culet side, particularly when bruting begins, and has the advantages that the cutting edges on the end of the bruting crown 1 can reengage the workpiece diamond 6, and the working stones 4 wear more evenly.

The finished girdle diameter must be greater than the diameter of the dop 8; furthermore, the length of the neck or reduced diameter part 9 of the dop 8 must be sufficient to accommodate the width of the bruting crown 1, i.e. the length of the neck 9 determines the maximum size of the grinding stones 4; however, if the neck 9 has a small diameter, it must be very short in order to have the necessary rigidity. This means that the finished girdle diameter in effect determines the width of the bruting crown 1 and the diameter of the grinding stones 4. In the case of a workpiece diamond 6 to finish at for example, 2 mm diameter, the neck 9 can be about 1.5 mm diameter; for such a diameter, a 3.5 mm length of neck 9 may be the upper limit.

The average reduction in radius of a bruting crown 1 of each of the Examples per bruted diamond 6, average 2 mm diameter, was 0.02±0.005 mm, which is satisfactory for determining the bruted diameter as described below in relation to FIG. 7. Discounting a required trimming loss at the commencement of the operation and a loss due to ineffective remnants at the termination, the bruting crown loss in radius in productive use will approximate to 2.3 mm, thus producing about 115 bruted workpiece diamonds 6 before replacement of the bruting crown 1 is necessary.

Table 2 gives preferred operating conditions. The bruting crown was that of Example 2 in Table 1, worn down to a diameter of 12 mm. Conditions can be varied for bruting crowns of other diameters. A workpiece diamond diameter of 2 mm is chosen, but the operation can be varied for diamonds 6 of other diameters, for instance 4 mm. The speeds chosen are near the maximum—if the speeds are higher, there is a danger of the workpiece diamond 6 coming off its dop 8. The peripheral speeds are given in the transverse plane (i.e. ignoring reciprocation). The ratio of the speeds of rotation of the bruting crown 1 to the workpiece diamond 6 is not precisely 1:2.5 as indicated, but is slightly different in order to avoid a bruting crown point returning to the same line on the workpiece diamond 6.

TABLE 2

| | | |
|---|---|---|
| Speed of rotation of workpiece diamond | 150 | rpm |
| Diameter of workpiece diamond | 2 | mm |
| Peripheral speed of workpiece diamond | about 900 | mm/min |
| Speed of rotation of bruting crown | 60 | rpm |
| Diameter of bruting crown | 12 | mm |
| Peripheral speed of bruting crown | about 2200 | mm/min |
| Relative peripheral speeds in transverse plane | 3100 | mm/min |
| Stroke of reciprocation | 3 | mm |
| Rate of reciprocation | 200 | cpm |
| Average speed of reciprocation | 1200 | mm/min |
| Average transverse:axial speed ratio | 31:12 | |
| Average helix angle | 69° | |
| Feed | | |
| main part (grinding) | 0.002 | mm steps |
| fine polishing | 0.001 | mm steps |

FIGURE 5

Figure 5:
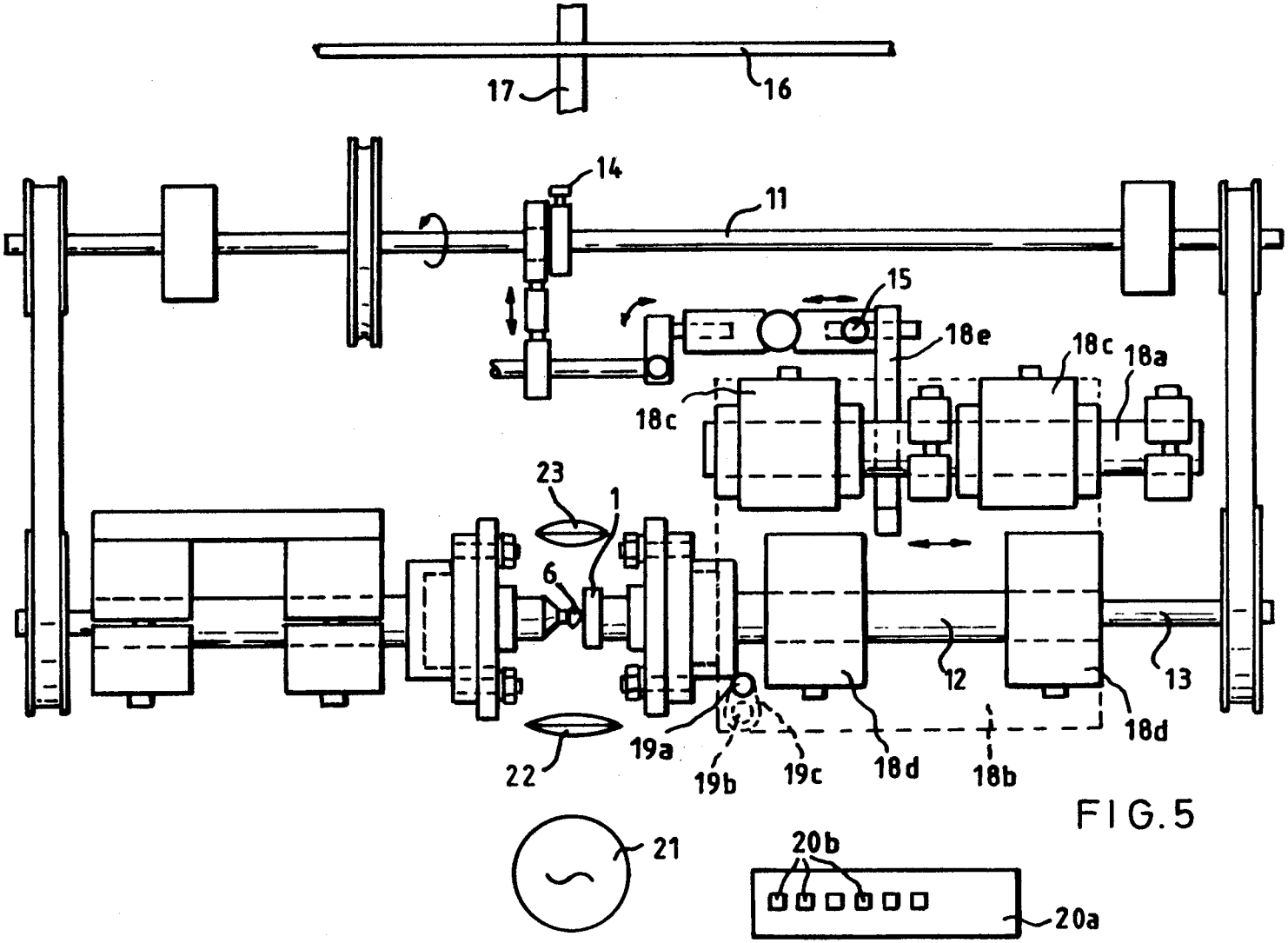
FIG. 5 is a top view of a bruting machine.

The bruting crown 1 can be used in the bruting machine of FIG. 5, which is similar to that described in FIG. 1 of GB-A-2 200 582. GB-A-2 200 582 can be referred to for a detailed description of the machine. Various modifications can be made, for instance by omitting the arrangement for altering the length of stroke (reciprocation), and if this is done, the main drive shaft 11 can be brought closer to the axes of the gemstone 6 and bruting crown 1; if the length of stroke is not adjustable, a simple eccentric could be used to provide reciprocation. A slot and key-way are provided in the connection between the spindle 12 and the pulley shaft 13 so that the spindle 12 and bruting crown 1 can be retracted to the right for registration of the end position and for stone replacement; this retraction can be merely to the right-hand extremity of the normal stroke. In practice, the stroke length is adjusted after slackening a screw 14, which is then tighted to fix the stroke length, and slackening a screw 15 allows the right-hand working side of the machine to be moved away from the working area, and then returned to abut against an end stop (not shown). The bruting crown 1 is shown in FIG. 5 a slightly retracted to the right.

Any suitable feed arrangement can be used, for instance as described in GB-A-2 200 582, or a ratchet drive, or a type of intermittent friction gear engagement. The rate of feed can be conventional—in general, if the rate of feed is too slow, fine polishing occurs, and if the rate of feed is too fast, there is a danger of cracking the workpiece diamond. As is conventional, the feed may be made in steps. In each case however an automatic end-stop with lift-off can be provided. The desired finished girdle diameter can be determined, e.g. as described below in relation to FIG. 7, and the machine arranged to give a signal, e.g. for automatic lift-off, when the periphery of the bruting crown 1 has reached this diameter; the feed end position is adjustable. In general, the desired diameter can be determined using a screen 16 (see FIG. 6 or 7), the periphery of the bruting crown 1 can be projected onto the screen 16 and brought down to the desired bruting diameter, the position registered or set in any suitable manner, e.g. by setting the position of a lift-off contact, by means of an encoding arrangement associated with the feed drive shaft or by using a photocell so that at the end position, the shadow of the bruting tool falls on the photocell (e.g. generally as shown in GB-A-2 074 480 or in FIG. 3 of GB-A-2 074 910). The bruting crown 1 is brought back up to its starting position before initiating bruting.

A preferred feed and automatic lift-off arrangement is shown in FIG. 5. The machine base (not shown) carries a pivot bar 18*a*. A horizontal top plate 18*b* (shown in dashed outline) carries below it pivot bearings 18*c* which pivot on the bar 18*a* and second bearings 18*d* which mount the spindle 12, as well as an L-shaped projection 18*e* for imparting oscillatory motion to the plate 18*b*. In this way, the spindle 12 can rock about the axis of the bar 18*a* and also move axially. A feed screw 19*a* is threaded into a threaded hole in the top plate 18*b* and engages the machine base by way of for instance a needle bearing to permit the lower end of the feed screw to slide over the base as the top plate 18*b* is reciprocated. A stepping motor 19*b* is mounted on the top plate 18*b* and is connected via a gear box 19*c* and a suitable spline arrangement (not shown) to the upper end of the feed screw 19*a*—the motor 19*b* and gear box 19*c* are shown schematically and not to scale. A control panel 20*a* controls the stepping motor by way of any suitable microprocessor. The feed programs can be inserted in the microprocessor, for instance an initial fast feed until the points of the workpiece stone 6 have been removed, then a slower feed for the main bruting and still slower feeds for finishing. Each step of the motor 19*b* can feed 1 or 2 microns, the fast feed being say about 1 micron/sec, main bruting about 1 micron/-sec and finishing down to about 0.2 micron/sec.

To register the end position, a registration key 20*b* is pressed, and advance and retract keys 20*c* and 20*f* are manipulated until the bruting crown 1 is in its correct end feed position. A set key 20*d* is pressed and the retract key 20*c* is pressed to retract the bruting crown 1 to just outside the widest part of the stone 6. The microprocessor registers the steps through which the motor 19*b* retracts. A start key 20*e* is pressed to initiate bruting. The programme is determined by the feed end position. When the feed end position is reached and the finishing operation is complete, the bruting crown 1 is automatically retracted to a position well clear of the stone 6.

The optical system is shown in FIG. 5, having a high intensity lamp 21 and a converging or condenser lens 22 in front of the diamond 6, a magnifying lens 23 behind the diamond 6 and the screen 16 on which the image of the diamond 6 is focused. Mirrors for example can be used so that the screen 16 is conveniently placed for the operator. The optical system is chosen to have a long depth of focus, and the screen 16 is on a slide 17 so that it can be slid along the optical axis to change the magnification. In one arrangement, the magnification range is approximately 10× to 20×. The magnifying lens 23 can be chosen as suitable—if there is space, a 15× lens can be used, though if there is less space a 20× lens can be used. In one arrangement, the distances between the components are roughly as follows:

Condenser lens 22 to bruting axis - 40 mm;
Bruting axis to magnifying lens 23 - 21 mm;
Magnifying lens 23 to screen 16 - 150 mm up to 210 mm (60 mm movement);
Focal length of magnifying lens 23 - 60 mm.

FIGURES 6 AND 7

Figure 6:
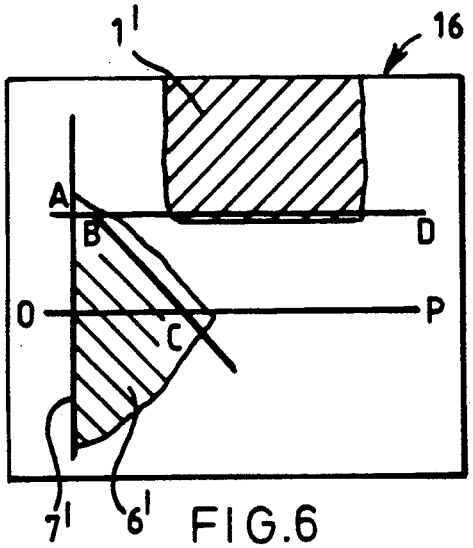
FIGS. 6 and 7 show two alternative screens that can be used to determine the girdle diameter.

In use with the arrangement shown in FIG. 6, the workpiece diamond 6 is already centred (as is the bruting crown 1). On the projection screen 16 (see FIG. 6) 6' is the image of the workpiece diamond 6, 7' is the image of the table 7, AB is the girdle line, C is the culet position, BD is an extension of the girdle line AB and 1' is part of the image of the bruting crown 1.

Figure 7:
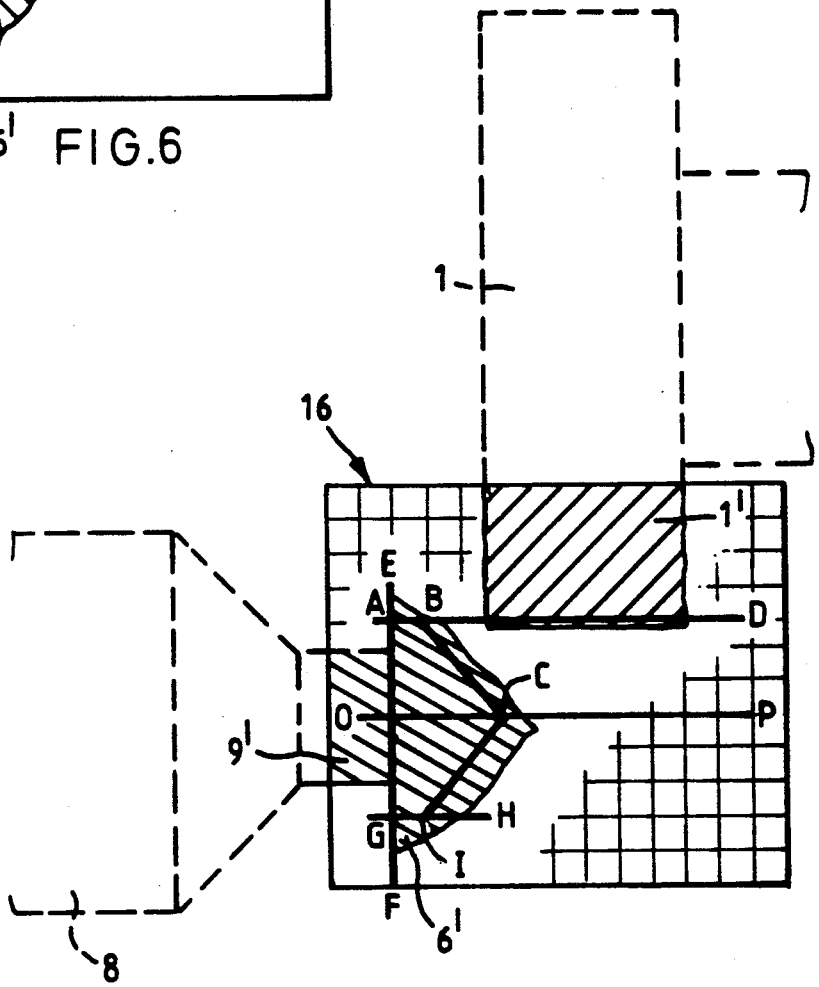

In use with the arrangement shown in FIG. 7, the bruting machine has some way of enabling the dop 8 to be adjusted radially once it is secured in position in the dop holder. The normal arrangement is to have a tapping chuck as a dop holder, the dop being moved radially by small taps.

The screen 16 of FIG. 7 carries ruled lines at for instance 1 mm spacing, and also carries indicia indicating the position of the bruted girdle 7 and for centering the diamond 6. The indicia carried are an axis line OP, a table line EF, two girdle diameter lines AB, GH and two pavillion lines BC, IC. The arrangement is such that the axis line OP coincides with the axis of rotation of the workpiece spindle (as projected). The upper girdle diameter line AB is extended to D as a guide to the final position of the bruting crown 1. The screen 16 carries the image 6' of the diamond 6, and if the table line EF is spaced from the edge of the screen 16 (as shown), the screen 16 will also carry the image 9' of the neck 9 of the dop 8. The screen 16 carries the image 1' of the edge of the working face or periphery of the bruting crown 1. FIG. 7 also shows the outline of the whole of the front part of the dop 8 and of the whole of the bruting crown 1, in dashed lines, at the same scale of magnification as the images 9', 1' on the screen 16.

A further line could be added just below the upper girdle diameter line AD, to indicate the final position of the bruting crown 1. In practice, it is found that this is not necessary, particularly if the screen 16 carries ruled lines as shown.

As the image of the table 7 must be accurately positioned on the table line EF, the movement of the screen 16 is such that the relative position of the table line EF does not alter as the magnification alters. This can be achieved by having the optical axis pass through the table line EF and moving the screen 16 parallel to the optical axis, or by having the screen 16 move at a small angle to the optical axis. If there is a problem, a small lateral adjustment can be provided for the screen 16 in order to bring the table line EF into the correct position.

As a general operating procedure for FIG. 6 or 7, the screen 16 is set for bruting, the bruting crown 1 is moved to the right to a clear position and lowered to 0.2 mm below the girdle line AB (with the projector magnification at 10×, the actual bruting crown position is 0.02 mm below the girdle 5, to allow for bruting crown wear).

The bruting crown 1 is then retracted to the required starting position and the bruting process is initiated. Once the end position is reached, the bruting crown 1 is withdrawn.

A specific operating procedure for FIG. 7 can be as follows:

a) remote from the bruting machine, the diamond 6 is stuck onto the dop 8 with cement in a conventional manner. All the dops 8 used have the same length.
b) the dop 8 is inserted in the bruting machine so that it comes up against an end stop. This ensures that the image of the front face of the dop (the table 7 of the diamond 6) coincides with the table line EF.
c) the screen 16 is moved until the image 6' of the diamond 6 is roughly the correct size for the indicia on the screen 16.
d) the diamond 6 is centered using the tapping chuck.

e) as part of the centering, the screen 16 is moved in order to correct the magnification so that the shape formed by the bruted girdle diameter lines AB, GH and the pavillion lines BC, IC, lies just within the profile of the image 6'.

f) Steps (d) and (e) are repeated after having rotated the diamond 6 through 90°.

g) the diamond 6 is rotated through at least 180° to ensure that there is no space between the image 6' of the diamond 6 and the girdle diameter lines AB, GH and pavillion lines BC, IC in any angular position of the diamond 6.

h) the bruting crown 1 is withdrawn axially to the right so that when it is brought up to the girdle diameter line AD, it does not touch the diamond 6.

i) the bruting crown 1 is set radially until the image of its edge is just below the upper girdle diameter line AD. The extent to which the image lies below the upper girdle diameter line AD is a matter of judgement, and depends primarily upon the loss in radius of the grinding wheel 1 while bruting that particular diamond 6, though there is a slight effect due to the spring of the dop 8 and of the machine components. For a diamond 6 of 2-3 mm diameter, the loss in radius of the bruting crown 1 may be less than 0.02 mm, which is 0.2 mm at 10× magnification on the screen 16; this can be judged as being for instance almost the thickness of the line AD or about ¼ of the distance between the ruled lines. The error in judging the reduction in diameter of the bruting crown 1 is roughly ±0.005 mm, and this is allowed for. Small errors are acceptable, particularly if they are less than the expected off-roundness of the diamond 6.

j) a contactor is set to determine the end position of the bruting crown 1 feed during bruting.

k) the bruting crown 1 is withdrawn to clear the highest point of the diamond 6.

l) the bruting crown 1 is advanced axially to its correct position (this can be part of its normal stroke during bruting) and bruting is initiated.

m) bruting is terminated when the pre-set and feed position is reached, and the bruting crown 1 is automatically withdrawn.

Step (i) can be simplified by modifying the bruting machine so that the image 1' of the bruting crown 1 is brought to the upper girdle diameter line AB, and the machine automatically adds on the extra feed required -this can be done electronically or mechanically.

When a number of gemstones are being bruted one after the other, the invention will normally be operated by determining the bruting tool working face prior to bruting substantially each gemstone, to take account of differing tool rates of wear for different gemstones; normally, the bruted girdle diameter will be determined prior to bruting each gemstone.

The various feed rates and/or reciprocation variations relative to the end position can be programmed via the encoding arrangement.

As an alternative to using the optical system shown in FIG. 5, it would be possible to use a TV viewer and all the various arrangements discussed in GB-A-2 080 712 can be incorporated, the screen being a TV screen. If a TV viewer is used, it is possible to use a second viewer in order to view the edge of the bruting crown 1 and superimpose the image on the same screen so that the bruting crown 1 can be moved radially to an end position which is radially outside the diamond 6, thus avoiding any danger of contacting the diamond 6, the end position being suitably transferred electronically. Alternatively, a TV viewer can view both the diamond 6 and the edge of the bruting crown 1, and the bruting crown 1 can be brought down to a feed end position line which is outside the diamond 6, the end position so determined automatically setting the correct end position for bruting.

As an alternative to using the bruting crown 1 for setting or registering the feed, a movable member other than the bruting crown 1 can be used for the registering or setting procedure, bringing said movable member to the end position without moving the bruting crown; the movable member could cast a shadow onto the screen 16. The movable member should be responsive to the actual diameter of the bruting crown 1 at the start of bruting the particular gemstone as the diameter of the bruting crown 1 reduces during bruting.

The present invention has been described above purely by way of example, and modifications can be made within the spirit of the invention.

We claim:

1. A method of working a gemstone workpiece, comprising rotating the workpiece stone about a workpiece stone axis and engaging a surface of the workpiece with a working face of a bruting crown which is rotated about a bruting crown axis, grinding stones set in said working face, each grinding stone having a leading part which is the first part of the grinding stone as the bruting crown rotates and a trailing part which is the last part of the grinding stone as the grinding stone rotates, each grinding stone subtending at the bruting crown axis an angle of at least about 10° between the leading part and the trailing part of the grinding stone.

2. The method of claim 1, wherein said angle is at the most about 60°.

3. The method of claim 1 wherein, as seen in section along the bruting crown axis, the working face of the bruting crown is at an angle to the bruting crown axis of about 75° or less.

4. The method of claim 1 wherein, as seen in section along the bruting crown axis, the working face of the bruting crown is substantially parallel to the bruting crown axis.

5. The method of claim 1, wherein relative reciprocation occurs between the bruting crown and the workpiece stone, parallel to that face of the workpiece stone which is being worked, as seen in axial section.

6. The method of claim 5, wherein the rate of reciprocation is greater than about 100 cycles per minute.

7. The method of claim 5, wherein the relative speed between the peripheries of the bruting crown and of the workpiece stone, in the plane normal to the axis of the bruting crown, is less than about 20,000 mm/min.

8. The method of claim 1, wherein the bruting crown speed is greater than about 30 rpm.

9. The method of claim 1, wherein the bruting crown speed is less than about 120 rpm.

10. The method of claim 1, wherein the workpiece stone is rotated at a speed of greater than about 80 rpm.

11. The method of claim 1, wherein the workpiece stone is rotated at a speed of below about 300 rpm.

12. The method of claim 1, wherein the diameter of the bruting crown is less than about 50 mm.

13. A bruting crown for working a gemstone workpiece by rotating the bruting crown about a bruting crown axis, the bruting crown having a working face in which are set grinding stones, each of which has a leading part which is the first part of the grinding stone as the bruting crown rotates and a trailing part which is the last part of the grinding stone as the bruting crown rotates, each stone subtending at the bruting crown axis an angle of at least about 10° between the leading part and the trailing part of the grinding stone.

14. A method of bruting a gemstone by rotating the stone about a gemstone axis and feeding the stone relative to a bruting tool in a direction radial to the gemstone axis to thereby provide radial feed and brute the stone, the method comprising:

determining the location of a working face of the bruting tool, determining the diameter of the bruted girdle of the gemstone, and hence registering the radial feed required for bruting the gemstone; and ceasing the feed at the radial feed registered.

15. A method of bruting a gemstone using a bruting tool, comprising:

securing the stone to a stone holder for rotation about an axis;

forming an image of the profile of the stone as seen normal to the axis, on a screen having indicia indicating the position of a girdle to be bruted on the stone;

forming on the screen an image of a movable member;

moving a movable member into a position related to the bruted girdle position such that feeding the bruting tool to a corresponding end position during bruting will brute the stone girdle substantially to the girdle position indicated;

registering said end position;

bruting the stone with the tool and ceasing the feed of the tool when the tool has reached said end position.

16. The method of claim 15, wherein said movable member is the bruting tool, which is moved radially to move the image of the tool edge profile on the screen.

17. The method of claim 15, and comprising changing the magnification of the image relative to the indicia, to fit the image to the indicia.

18. The method of claim 17, wherein the image is formed on the screen by optically projecting an image of the profile of the stone onto the screen, and changing the magnification and thereby changing the size of the image, to fit the image to the indicia on the screen.

19. The method of claim 14, wherein the bruting tool comprises a rotary bruting crown having a working face in which are set grinding stones, each of which has a leading part which is the first part of the grinding stone as the bruting crown rotates and a trailing part which is the last part of the grinding stone as the bruting crown rotates, each grinding stone subtending at the axis of the bruting crown an angle of at least about 10° between the leading part and the trailing part of the grinding stone.

20. A bruting machine for bruting rotating gemstones using a bruting tool by rotating the gemstone about a gemstone axis and feeding the gemstone relative to the tool in a direction radial to the gemstone axis to thereby provide radial feed and work the gemstone, the machine comprising:

means for determining the location of a working face of the bruting tool prior to bruting a gemstone;

means for determining the diameter of a girdle to be bruted on the gemstone;

means for registering the radial feed required for bruting the gemstone, on the basis of the bruting tool working face location and the bruted girdle diameter; and means for signalling when, during bruting, said required radial feed is reached.

21. A machine for bruting a gemstone, comprising:

means for mounting the stone;

means for mounting a bruting tool;

a screen which has indicia indicating the position of a girdle to be bruted on the stone;

means for forming an image of the profile of the stone, as seen normal to the bruting axis, on the screen, and for forming on the screen an image of a bruting tool;

means for moving the bruting tool into a position related to the bruted girdle position such that feeding the bruting tool to a corresponding end position during bruting will brute the stone girdle to the girdle position indicated; and means for registering said end position of the bruting tool.

22. The bruting machine of claim 21, wherein said moving means are for moving the bruting tool radially along such a path that it does not contact the stone, to move the image of the bruting tool edge into an end radial position related to the bruted girdle position.

23. The bruting machine of claim 20, and comprising means for automatically ceasing the feed of the bruting tool during bruting when the bruting tool has reached said end position.

24. The bruting machine of claim 21, and comprising means for changing the magnification of the image of the stone relative to the indicia, to fit the stone image to the indicia.

25. The bruting machine of claim 24, wherein the image forming means comprise means for optically projecting an image of the profile of the stone, as seen normal to the bruting axis, onto the screen, and means for changing the magnification of the system comprising the optical projecting means and the screen to thereby change the size of the image on the screen to fit the image to the indicia.

26. The method of claim 2, wherein, as seen in section along the bruting crown axis, the working face of the bruting crown is at an angle to the bruting crown of about 75° or less.

* * * * *